US005778901A

United States Patent [19]

Abrahamian

[11] Patent Number: 5,778,901

[45] Date of Patent: Jul. 14, 1998

[54] NAIL POLISH KIT FOR MIXING NAIL POLISH

[76] Inventor: Sandra L. Abrahamian, 10 Lakeside Ave., Worcester, Mass. 01603

[21] Appl. No.: 853,715

[22] Filed: May 9, 1997

Related U.S. Application Data

[60] Provisional application No. 60/017,896 May 17, 1996.

[51] Int. Cl.[6] ..... A45D 29/18

[52] U.S. Cl. ..... 132/74.5; 132/313; 132/317; 206/581; 206/229

[58] Field of Search ..... 132/73.5, 73, 74.5, 132/75, 313, 200, 285, 317; 206/581, 229; 424/61, 401

[56] References Cited

U.S. PATENT DOCUMENTS

| | | | |
|---|---|---|---|
| 1,974,466 | 9/1934 | Marshburn . | |
| 2,209,781 | 7/1940 | Lewis | 206/581 |
| 2,219,597 | 10/1940 | Lutz | 206/581 |
| 2,822,082 | 2/1958 | Breckwoldt et al. | 206/229 |
| 2,995,459 | 8/1961 | Soloway . | |
| 3,225,914 | 12/1965 | Klein et al. | 206/229 |
| 3,491,875 | 1/1970 | Fischer et al. | 206/229 |
| 3,982,551 | 9/1976 | Bartolucci | 132/73 |
| 4,194,617 | 3/1980 | Bandell | 206/581 |
| 4,301,046 | 11/1981 | Schlossman . | |
| 4,740,370 | 4/1988 | Faryniarz et al. . | |
| 5,370,866 | 12/1994 | Frankfurt et al. . | |

FOREIGN PATENT DOCUMENTS

| | | | |
|---|---|---|---|
| 925276 | 4/1947 | France | 132/73 |
| 406191556 | 7/1994 | Japan | 206/581 |
| 392982 | 6/1933 | United Kingdom | 132/73 |

*Primary Examiner*—Todd E. Manahan
*Assistant Examiner*—E. Robert
*Attorney, Agent, or Firm*—Richard C. Litman

[57] ABSTRACT

A personal nail polish kit for individuals who desire to create their own nail polish having a desired color and hue. The kit includes a variety of mixable nail polish solutions, a variety of pigments, and various tools and utensils to accomplish the mixing and application of the nail polishes. Specifically, the kit includes: at least two dispensing bottles of nail polish, one of which is clear and the other of which is white; disposable tools and utensils such as mixing cups, mixing paddles, and application brushes; and tubes of pigment colors such as black, red, yellow, blue, silver, and gold. The tubes of pigment colors may be used to create a broad array of nail polish colors and hues when the pigment is mixed with clear and/or white nail polish solutions. A coloring guide is provided to assist the individual with mixing of proper proportions of the pigment colors and nail polish solutions to obtain a number of desirable colors and hues.

11 Claims, 3 Drawing Sheets

NAIL POLISH KIT FOR MIXING NAIL POLISH

CROSS-REFERENCE TO RELATED APPLICATION

This application claims the benefit of U.S. Provisional Patent Application Ser. No. 60/017,896, filed May 17, 1996.

BACKGROUND OF THE INVENTION

1. Field of the Invention

The present invention generally relates to nail polish kits. More specifically, the present invention relates to a nail polish kit which contains a variety of mixable nail polish colors that a user may selectively mix to produce a desired nail polish color.

2. Description of the Prior Art

Nail polish typically is bought and sold in small containers which are provided with an applicator brush. Such containers contain a single nail polish having a predetermined color and hue. It is common for individuals to purchase a large number of different nail polish colors and hues to accommodate their wardrobe. However, additions to an individual's wardrobe often require the purchase of a new, matching nail polish color. Likewise, a change in attire often requires a change in the nail polish and other accessories an individual chooses wear. The ability of an individual to satisfactorily achieve such a change of attire depends upon whether matching accessories, including nail polish, are available. This is particularly true where an individual intends to dress in a specific costume and wear suitable accompanying makeup. Furthermore, the colors and hues of commercially available nail polishes may not necessarily satisfy each individual. Thus, in many instances it is desirable for an individual to have the capability to easily and selectively produce a nail polish having a desirable color and hue.

While the prior art contains a number of compositions concerning nail polish and its sale and manufacture, the prior art has failed to fully address the problem an individual may have in selecting a desired nail polish color and hue for a specific occasion. The prior art will be discussed in the order of their perceived relevance to the present invention.

U.S. Pat. No. 5,370,866 issued on Dec. 6, 1994, to Christopher C. Frankfurt et al. describes a colorless or colored nail polish composition containing aramide fibers for improved adhesion and strength of the polish on the nails.

U.S. Pat. No. 2,995,459 issued on Aug. 8, 1961, to Saul Soloway describes a method of coloring nacreous (mother-of-pearl) materials and the fingernail lacquer product compositions which can have gold and silver containing compounds.

U.S. Pat. No. 4,301,046 issued on Nov. 17, 1981, to Mitchell L. Schlossman describes a universal nail polish composition containing polyester resin.

U.S. Pat. No. 4,740,370 issued on Apr. 26, 1988, to Joseph R. Faryniarz et al. describes a process for preparing nail coating compositions containing pigment greater than 2% by weight and a Newtonian viscosity not greater than about 600 centipoise. The mill base and pigments are milled in high-energy milling equipment.

U.S. Pat. No. 1,974,466 issued on Sep. 25, 1934, to Preston W. Marshburn describes a nail polish package having a detachable chart of nail polish colors in graduated tints.

The prior art fails to provide a nail polish kit that an individual may use to easily and selectively produce a desired nail polish having a particular color and hue. Thus, there is a need for a nail polish kit that includes a variety of mixable nail polishes, a variety of pigment colors, and various tools to accomplish the mixing of the nail polishes for the purpose of selectively producing a desired nail polish having a particular color and hue.

None of the above inventions and patents, taken either singly or in combination, is seen to describe the instant invention as claimed.

SUMMARY OF THE INVENTION

Accordingly, it is a principal object of the invention to provide a nail polish kit which allows an individual to selectively produce a desired nail polish having a particular color and hue.

It is also an object of the invention to provide a nail polish kit that an individual may use to quickly and easily mix certain basic colors with provided tools and utensils, and then paint the nails with a provided nail polish brush in a minimum of time.

It is another object of the invention to provide in the kit several large pump bottles of clear and white nail polish solutions.

It is a further object of the invention to provide environmentally safe utensils for mixing and applying the desired nail polish solutions to one's nails.

Still another object of the invention is to provide resealable tubes containing pigmented preparations of nail polish in primary colors and black.

Yet another object of the invention is to provide an instruction guide which illustrates the various color combinations obtained by mixing predetermined amounts of specific colors.

The present invention is a personal nail polish kit for individuals who desire to create their own nail polish having a desired color and hue. The kit includes a variety of mixable nail polish solutions, a variety of pigments, and various tools and utensils to accomplish the mixing and application of the nail polishes. Specifically, the kit includes: at least two dispensing bottles of nail polish, one of which is clear and the other of which is white; disposable tools and utensils such as mixing cups, mixing paddles, and application brushes; and tubes of pigment colors such as black, red, yellow, blue, silver, and gold. The tubes of pigment colors maybe used to create a broad array of nail polish colors and hues when the pigment is mixed with clear and/or white nail polish solutions. A coloring guide is provided to assist the individual with mixing of proper proportions of the pigment colors and nail polish solutions to obtain a number of desirable colors and hues.

It is an object of the invention to provide improved elements and arrangements thereof in a kit for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a personal nail polish kit with which the user can selectively create a nail polish having a desired color and hue. The various primary pigment colors provided with the kit may be used alone or they can be mixed together to create an infinitely variable number of nail polish colors and hues, which offer creative nail polish coloring to complement festive costumes and ordinary dress. A coloring guide is provided to assist the user with mixing of proper proportions of the pigment colors and nail polish solutions to obtain a number of desirable colors and hues.

Today, the public is more conscious of the environment being contaminated by plastic materials. Therefore, it is desirable to utilize biodegradable tools and utensils for mixing and application of the nail polish. The preferred utensils and tools are preferably disposable and made of wood.

Figure 1:
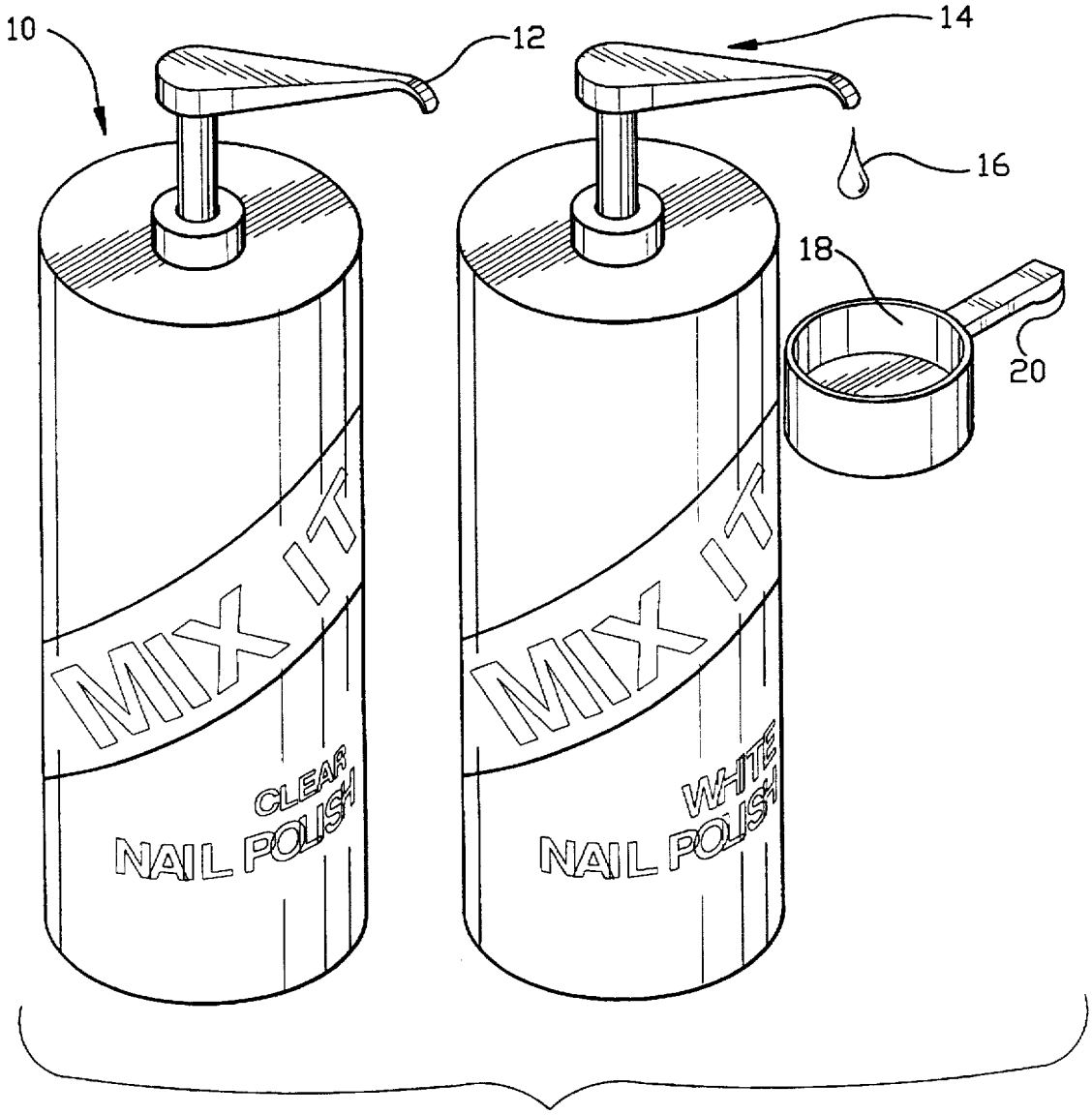
FIG. 1 is a perspective view of two pump bottles containing clear and white nail polish with a disposable wooden cup collecting nail polish from one pump bottle.
Figure 2:
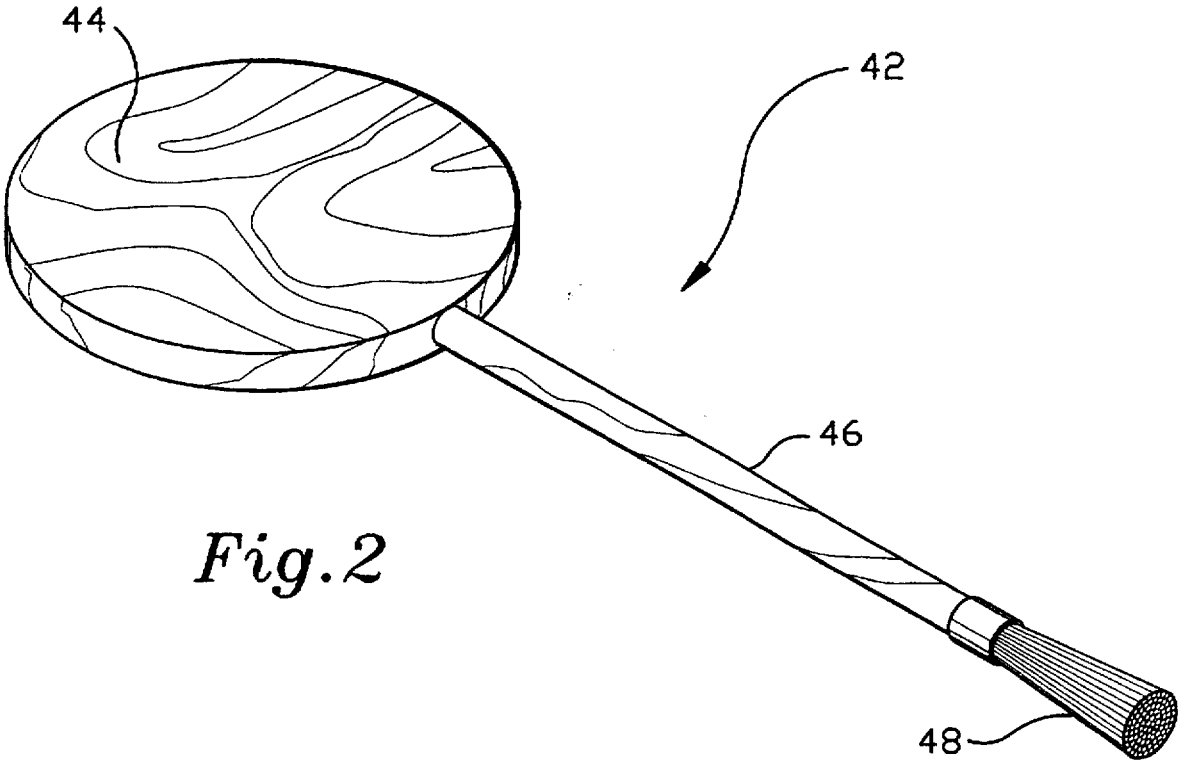
FIG. 2 is a perspective view of the disposable application brush of the invention.
Figure 4:
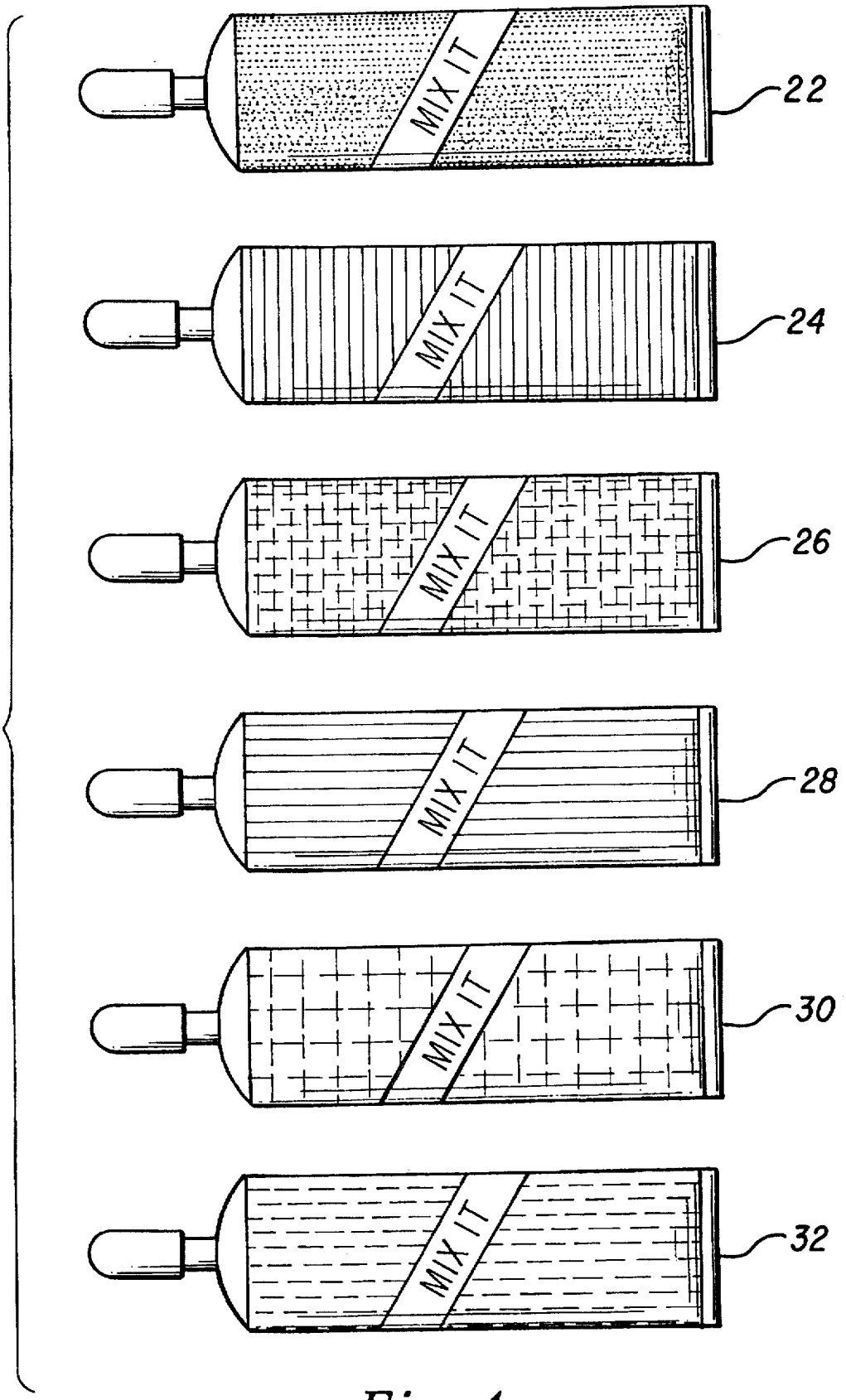
FIG. 4 is an arrangement of color pigments suitable for the present invention.

In FIG. 1, a "Mix It" bottle 10 of clear nail polish is provided with a pump 12. Another "Mix It" bottle 14 of white pigmented nail polish with a similar pump 12 is shown pumping drops 16 of its white nail polish into a wooden cup 18 having a handle 20. The wooden cup holds several liquid ounces of nail polish. A user can begin with either clear or white nail polish solutions and then add small amounts of one or more liquid pigment colors selected from the tubes of color depicted in FIG. 4. The following representative "Mix It" coloring tubes are illustrated in FIG. 4 as follows: Black 22, red 24, yellow 26, blue 28, gold 30, and silver 32.

The various nail polish solutions and color mixtures are based on mixtures of acetone, ethyl acetate, propyl acetate and/or butyl acetate with a pigment and smaller amounts of nitrocellulose and isopropyl alcohol.

Figure 3:
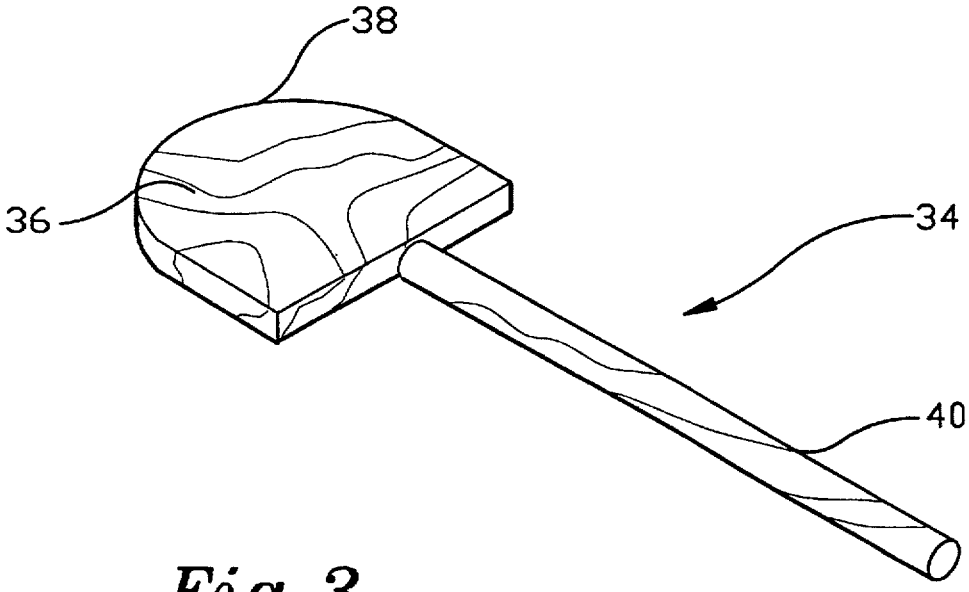
FIG. 3 is a perspective view of the disposable wooden mixing paddle of the invention.

A wooden mixing paddle 34 of a convenient size having a flat blade 36 with a curvilinear edge 38 and a cylindrical handle 40 as illustrated in FIG. 3, is utilized for the mixing operation. When the desired color and hue is obtained, the user can use an ergonomic nail polish applicator or brush 42 to paint a finger or toe nail. The brush 42 includes a flat circular handle 44 at one end of a post 46, and a brush head having bristles 48 (preferably natural bristles) at the opposite end of the post.

For example, if a dark maroon color is desired, the user will begin with ten drops of clear nail polish from bottle 10 deposited into the wooden cup 18. Enough red pigmented color from tube 24 will be added to obtain a saturated red nail polish by thoroughly stirring the mixture with the wooden mixing paddle 34. Then, a dab or drop of the black color from tube 22 is added to the red nail polish solution and stirred. It is well known in the paint industry that fresh wet colors are not the same shade as when dried. Therefore, it is preferable to allow a sample drop to dry on paper or on the nail to determine the final dry color of the nail polish mixture. If the dry color of the nail polish mixture needs to be adjusted, the user may add other pigment colors as desired. If a metallic sheen is desirable, the user can add a dab or drop of gold 30 or silver 32. If the user decides to lighten the shade, white nail polish from the bottle 14 can be added dropwise and mixed into the maroon nail polish mixture.

It is known that several coats of nail polish are applied stepwise after the undercoat has dried sufficiently. If the user prefers to change the shade slightly after one coating, the user can add further pigment colors to the original mixture. This advantage is unavailable to a user with a bottle of a certain color. The clear nail polish in bottle 10 can be applied on top of the colored layers as a finish coat.

The wooden cup 18, the wooden mixing paddle 34 and the wooden paintbrush 42 can all be used over again if desirable by washing with acetone or the like solvent. If the utensils are discolored or after repeated use, the user can dispense them with the confidence that the wooden utensils are biodegradable and they will not adversely affect the environment. The mixing paddle 34 can be made from plastic if a stronger handle 40 is desired.

The nail polish kit can conveniently include a quantity of the wooden utensils. It is contemplated that the kit is not limited to only seven pigment colors, and that other pigment colors can be added to the "Mix It" nail polish kit.

It is to be understood that the present invention is not limited to the sole embodiment described above, but encompasses any and all embodiments within the scope of the following claims.

I Claim:

1. A nail polish kit, comprising:

at least two nail polish containers, one of said at least two nail polish containers containing a clear nail polish and another of said at least two nail polish containers containing a white nail polish;

a plurality of pigment color containers, each of said pigment color containers containing a pigment color;

a plurality of mixing tools; and at least one applicator brush;

whereby a desired color and hue of nail polish can be prepared by selecting one nail polish from said clear nail polish and said white nail polish, and mixing said one nail polish with at least one of said pigment colors using said mixing tools, and said desired color and hue of nail polish can be applied to a nail with said at least one applicator brush.

2. The nail polish kit according to claim 1, including an instruction guide indicating various nail polish colors and hues obtainable by mixing said pigment colors and said nail polish in predetermined proportions.

3. The nail polish kit according to claim 1, wherein said pigment colors are selected from the group consisting of black, red, yellow, blue, gold, and silver.

4. The nail polish kit according to claim 1, wherein said at least two nail polish containers are pump bottles.

5. The nail polish kit according to claim 1, wherein said plurality of mixing tools comprises:

a biodegradable cup with a handle; and a biodegradable mixing paddle.

6. The nail polish kit according to claim 5, wherein said cup and said mixing paddle are wooden.

7. The nail polish kit according to claim 1, wherein said at least one applicator brush is biodegradable.

8. The nail polish kit according to claim 7, wherein said at least one applicator brush includes a wooden handle and a natural bristle brush.

9. A nail polish kit, comprising:

a first pump bottle containing clear nail polish;

a second pump bottle containing white pigmented nail polish;

at least one disposable cup with a handle made from wood;

at least one disposable mixing paddle made from a material selected from the group consisting of wood and plastic;

at least one disposable applicator brush having a wooden handle and a brush head formed from natural bristles; and at least six tubes of different pigment colors;

whereby a desired color and hue of nail polish can be prepared by selecting one nail polish from said clear nail polish and said white nail polish, and mixing said one nail polish with at least one of said pigment colors in said at least one disposable cup with said at least one disposable mixing paddle, and said desired color and hue of nail polish can be applied to a nail with said at least one disposable applicator brush.

10. A nail polish kit according to claim 9, wherein each tube of pigment color from said at least six tubes contains a pigment color selected from the group consisting of black, red, yellow, blue, gold, and silver.

11. The personal color mixing nail color kit according to claim 10, including an instruction guide indicating various nail polish colors and hues obtainable by mixing said pigment colors and said nail polish in predetermined proportions.

* * * * *

UNITED STATES PATENT AND TRADEMARK OFFICE

CERTIFICATE OF CORRECTION

PATENT NO. : 5, 778,901
DATED : July 14, 1998
INVENTOR(S) : Sandra L. Abrahamian It is certified that error appears in the above-indentified patent and that said Letters Patent is hereby corrected as shown below:

On the title page, item [76], in the address change "10 Lakeside" to--39 B TIMROD DR.--.

Signed and Sealed this

Fifteenth Day of September, 1998

Bruce Lehman

*Attest:*

BRUCE LEHMAN

*Attesting Officer*

*Commissioner of Patents and Trademarks*